United States Patent [19]

Frazier et al.

[11] Patent Number: 4,667,845

[45] Date of Patent: May 26, 1987

[54] TABLET DISPENSER

[75] Inventors: Thomas A. Frazier, Williamsport; Allen D. Lowe, Montgomery, both of Pa.

[73] Assignee: Ortho Pharmaceutical Corporation, Raritan, N.J.

[21] Appl. No.: 747,498

[22] Filed: Jun. 21, 1985

[51] Int. Cl.[4] ..... B65D 83/04

[52] U.S. Cl. ..... 221/5; 221/25; 221/87; 116/308

[58] Field of Search ..... 221/2, 4–5, 221/25, 76, 86–87, 89, 69, 64, 82; 206/531–534, 538–539; 116/308

[56] References Cited

U.S. PATENT DOCUMENTS

| | | | |
|---|---|---|---|
| 3,570,707 | 3/1971 | Finkel | 221/5 |
| 4,165,709 | 8/1979 | Studer | 221/86 X |

FOREIGN PATENT DOCUMENTS

| | | | |
|---|---|---|---|
| 1806343 | 6/1969 | Fed. Rep. of Germany | 221/2 |
| 442615 | 1/1968 | Switzerland | 206/534 |
| 1187060 | 4/1970 | United Kingdom | 221/82 |

*Primary Examiner*—Charles A. Marmor

*Attorney, Agent, or Firm*—Benjamin F. Lambert

[57] ABSTRACT

A tablet dispenser for dispensing a series of different pills over a prescribed period. The dispenser is provided with a daily indicator that can be present to begin the regimen on whatever day is selected. The tablet package when used up can be readily replaced with a new package and the indicator reset as desired.

6 Claims, 6 Drawing Figures

TABLET DISPENSER

The present invention relates to a device for dispensing tablets, or the like, that are to be taken during specified periods. It has particular application to the dispensing of medicines that are to be taken on a periodic basis, such as birth control pills.

Tablets, or pills, that are used for regulating blood pressure, birth control, or a variety of other ailments are often intended to be taken on a daily or other periodic basis in order to insure that the maximum effectiveness of the medication is obtained. In this regard, it is desirable to provide a dispenser that will indicate the prescribed frequency for taking the pill, or tablet, in accordance with the doctor's recommendations. The device must be simple and easy to use so as to avoid any uncertainty, forgetfulness, or confusion as to whether or not the medicine has been taken at the prescribed time periods.

It is recognized that there are currently available on the market tablet dispensers and devices for dispensing solid form pharmaceutical preparations in a prescribed time-related sequence. Examples of these types of tablet dispensers are disclosed in assignee's U.S. Pat. No. 4,165,709 and other U.S. Pat. Nos. such as, 3,904,075, 3,800,940, 3,651,927 3,743,085, and 3,276,573.

Referring specifically to assignee's U.S. Pat. No. 4,165,709, which discloses a pill dispenser similar to the one described and claimed in this application, it is to be noted that the novel pill dispenser disclosed therein does not provide for starting the tablet regimen on other than a previously set day. This day has been established by the manufacturer who produced the dispenser and the tablet package. The dispenser is designed to receive the package in the particular orientation, with the result that the first tablet of the regimen is to be taken on the day marked on the indicator. Since the relationship between the first tablet and preset day is fixed, movement of the tray on which the tablet package is located to take the first tablet on a different day is clearly not acceptable if the tablet regimen requires the taking of different pills in a prescribed sequence. Thus, it can be appreciated that in the case of a dispenser being used for prescribing the taking of a series of different tablets beginning on a given day other than the one preset by the manufacturer, this dispenser would not conveniently serve that purpose. This situation is but one example of a situation in which the dispenser disclosed in the '709 patent could not be used to start at some time other than on the day or time previously preset on the dial for taking the first of a series of different tablets. The dial, while listing days, of course, could include other indicia, such as, times, or types of sequential indicia. In each case, the user does not have the desired flexibility to start taking the prescribed medication at some period other than that preset by the manufacturer of the dispenser.

SUMMARY OF THE INVENTION

In accordance with the present invention, there is provided a simple and inexpensive tablet dispenser used for dispensing tablets to be used on a periodic basis. For purposes of illustration only, the discussion will be directed to a series of different tablets that are to be dispensed on a daily basis in a prescribed sequence.

Thus, for a tablet dispenser to be used for birth control pills consisting of three groups of tablets that are to be started in a given daily sequence at a time predetermined by the onset of the user's menstrual period, the indicia mechanism lists days of the week, and in the example illustrated discloses a four-week period. The tablets to be ingested are part of a tablet dispensing package containing a plurality of tablets that are positively positioned on a support tray located on the support portion of the dispenser. The tablets are individually dispensable though an opening in the tray, when the opening in the tray is aligned with an aperture formed in the support of the dispenser. The tray on which the tablet dispensing package is located is incrementally rotatable, and when the tray is rotated relative to the dispenser support, it will locate the next tablet in position to be removed from the dispenser and taken by the user.

Located on the tray and movable relative thereto is the period indicator which, as previously mentioned, lists the days of the week over a several-week period. The user will be aware upon opening the package as to the tablet to be taken on a daily basis, and all he needs to remember is that they are to be taken in sequence. However, if the day preset on the period indicator is not the day the user is to start taking the first tablet of a prescribed sequence, the period indicator must be adjustable relative to the tray, so that the first tablet to be taken from the tablet dispenser is set to be taken on the day the user is required to take the first tablet of the required sequence. If provision is not made for the desired positioning of the period indicator and the first tablet of a sequence is to be taken on a day other than the one set on the indicator, the user is left with the choice of remembering what the original setting was and discipline herself to take one every day without fail or wait until the day indicated on the dial to take the tablet, both of which situations put the user at risk.

In accordance with the present invention, the period indicator is adjustable relative to the tray supporting the tablet dispensing package so that the first tablet in the required regimen can be designated to be taken on whatever day desired by the user. To this end, the first tablet to be taken is placed in a preset fixed position in the dispenser with the first tablet to be taken located over the dispenser openings. The period indicator mounted on and movable relative to the tray in which the tablet dispenser package is rotated to place the right day in alignment with the first tablet. The adjustable movement of the indicator is opposite to that in which the tray is moved to sequentially place tablets into position to be dispensed. After the indicator has been moved to designate the right day, it will remain fixed relative to the tray and will move with the tray to provide the requisite information to the user. Thus, after the indicator has been adjusted to set up the starting day, movement of the tray after each tablet is taken will place a succeeding tablet in position for dispensing and the day for taking it will be so indicated.

The novel tablet dispenser disclosed herein contains all the advantages of that disclosed in assignee's U.S. Pat. No. 4,165,709 in that it can accept a replaceable tablet package, so that the tablet dispenser may be reused many times, which can be done by merely removing the exhausted tablet package and inserting a new full tablet package. Furthermore, the structure of the novel tablet dispenser is very convenient and can be easily handled, and its compact-like configuration allows it to be held in the palm of the hand and then readily slipped into a pocket or purse until its next use.

BRIEF DESCRIPTION OF THE DRAWINGS

Numerous other advantages and features of the present invention will become readily apparent from the following detailed description of the invention and embodiment thereof, from the claims, and from the accompanying drawings in which like numerals are employed to designate like parts throughout the same.

DETAILED DESCRIPTION

Figure 1:
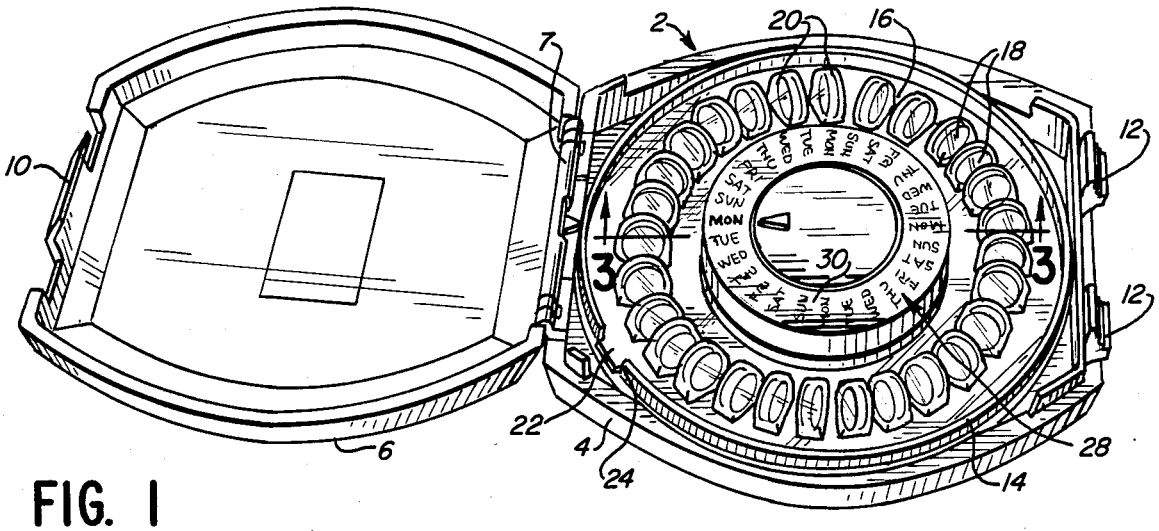
FIG. 1 is a perspective view of a tablet dispenser incorporating the present invention.

Referring first to FIG. 1, there is shown the tablet dispenser 2 which consists of a bottom support 4 and a cover 6 that is hinged at 7 to the support 4. The cover 6 includes a tab 10 and the support 4 includes finger grips 12 to facilitate opening of the dispenser. Located within the support 4 is a rotatable tray 14 within which is disposed a tablet package 16 consisting of a circular array of tablets 18. The tablet package 16 is a blister pack in which tablets 18 are located in separate sections that are to be dispensed in a prescribed sequence. The individual tablets 18 are located within separate clear plastic compartments 20, the bottoms of which are closed by frangible sections (not shown) that are broken away to release the tablet from the package when a tablet is to be taken by a user. The blister pack 16 is provided with a tab 22 that fits into a notch 24 of the tray 14 to positively locate the pack 16 relative to the tray. With this arrangement, the first tablet of the tablet regimen consisting of different groups of tablets to be taken is located in the required position to be dispensed through an aperture 26 in the support 4 (see FIG. 2). Notch 24 is formed in the sidewall 15 of the tray which includes an upper gripping portion 17 to aid in rotating the tray during dispensing.

To properly indicate the day that the first tablet is to be taken, there is located within the circle of circumferentially spaced tablets 18 the period indicator 28 that includes an annular surface portion 30 on which are marked appropriate indicia corresponding to each of the tablets. In the illustrated embodiment, the indicia consists of days in a week for four consecutive weeks, but obviously it can contain other indicia suitable for indicating when the tablets are to be dispensed. The structural details of the indicator 28 are to be subsequently described.

Figure 2:
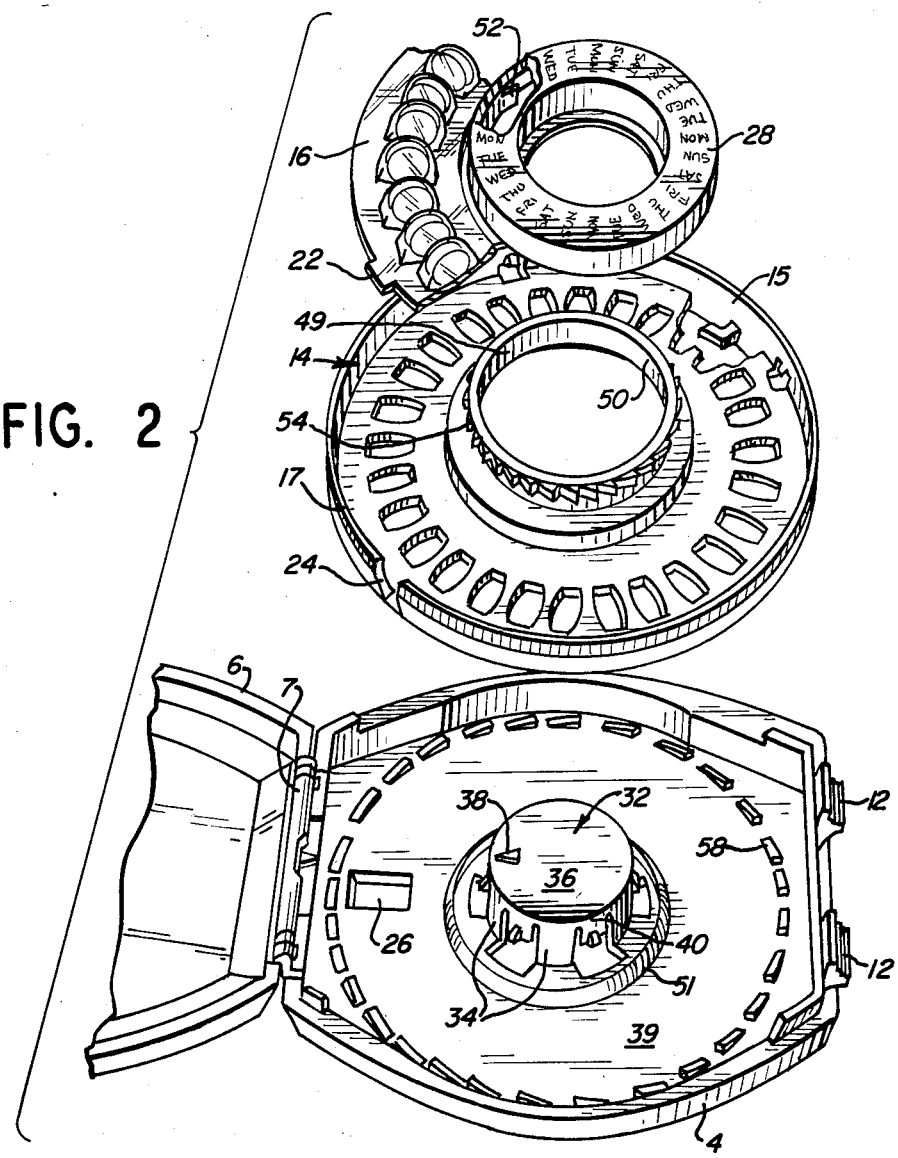
FIG. 2 is an exploded perspective view partially broken away indicating the elements shown in FIG. 1.
Figure 3:
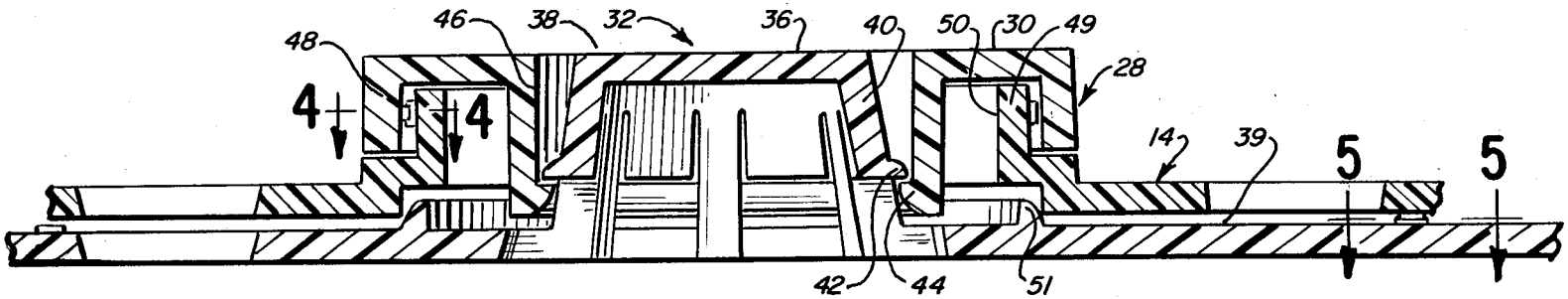
FIG. 3 is a view taken along line 3—3 of FIG. 1 with the tablet package removed.
Figure 5:
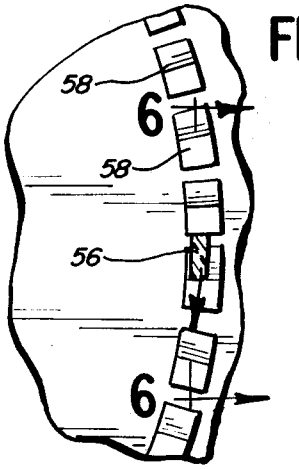
FIG. 5 is a partial view taken along line 5—5 of FIG. 3.
Figure 6:
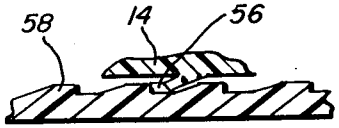
FIG. 6 is a partial side elevational view of the ratchet teeth interconnection taken along line 6—6 of FIG. 5.

Turning first to FIG. 2, there are illustrated the structural components of the support 4 for the tray 14, indicator 28, and tablet package 16. The support 4 contains a raised hub portion 32 that is formed integrally with support spokes 34. The upper surface of the hub 32 includes a flat portion 36 on which is formed a pointer 38 that points to the tablet dispensing aperture 26 formed in the bottom wall 39 of the support 4. Located on the sidewall of the hub 32 are a plurality of circumferentially spaced resilient spring-like spokes 40. As illustrated in FIG. 3, spokes 40 include projections 42 that are located above annular lip 44 of indicator 28 to retain the indicator 28 in position relative to hub 32. The lip 44 extends outwardly from cylindrical wall 46 of indicator 28. Radially spaced from wall 46 is cylindrical wall 48 of indicator 28, which engages tray 14 to retain it in its proper location within the support 4. The tray 14 includes an inner generally cylindrical wall 49 which defines an opening 50 larger than hub 32 and when in position relative to the support 4 is located over the hub 32. As shown in FIG. 3, the indicator 28 fits over the cylindrical wall 49 of the tray 14 and its upper surface 30 is coplanar with hub 32. To further facilitate proper positioning of the tray 14 relative to the support 4, support 4 is provided with a centering ring 51 formed integral with the bottom wall 39 of support 4.

Figure 4:
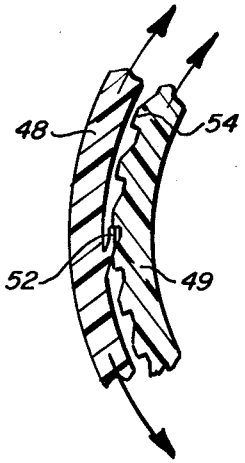
FIG. 4 is a partial view taken along line 4—4 of FIG. 3.

In order to enable the user to adjust the position of the indicia indicator 28 to the day that the user wishes to start the regimen, it is necessary that the annular period indicator be moved relative to the pointer 38 so that the correct day is in alignment between the pointer 38 and the tablet dispensing aperture 26. To this end, the annular period indicator 28 which is of a generally inverted U-shape in cross section, as described hereinbefore, defines a plurality of teeth that engage with cooperating teeth defined by the tray 14. Specifically, as shown in FIG. 4, wall 48 of indicator 28 defines flexible projections 52 that serve as teeth that engage with ratchet teeth 54 formed on the outer surface of tray wall 49. It can be appreciated that with this cooperating ratchet construction the period indicator 28 can be moved in a counterclockwise direction relative to the tray 14 to the day desired. Once the indicator is preset, it will remain fixed relative to the tray and thus movement of the tray in the clockwise direction will carry along with it the period indicator 28.

To facilitate the proper dispensing positioning of the tray 14 relative to the support 4, the tray 14 has formed on its lower surface a plurality of flexible teeth-like projections 56 which cooperate with ratchet teeth 58 formed on the bottom wall 39 of support 4. There are as many ratchet teeth 58 as the number of tablets to be dispensed, so that movement of one ratchet tooth will be equivalent to that distance required to move the tray between adjacent tablets. It is seen that the shape of the teeth is such that the tray can be moved in a clockwise direction relative to the support, but will be prevented from moving in a counterclockwise direction.

From the above, it can be seen that with applicant's novel construction the time at which the first tablet of a regimen of different tablets to be taken in a prescribed sequence is to be taken can be preset to whatever period is indicated on the dial of the position indicator by merely moving the position indicator relative to the tray support.

It is intended to cover by the appended claims all such modifications that fall within the true spirit and scope of the invention.

What is claimed is:

1. A tablet dispenser comprising:

a substantially flat support having a single tablet dispensing aperture therein:

a tray rotatably disposed relative to said support, said tray having a plurality of openings disposed in a circular orientation and spaced substantially equally apart and arranged to individually align in registration with said aperture in said support upon rotation of said tray relative to said support, a periodicity indicator mounted on said tray and associated with each of said openings.

interengaging means defined by said indicator and tray wherein said tray is rotatably positioned relative to said support and said indicator can be moved independently of said tray when moved in one direction and will move with said tray when the tray is moved in the opposite direction, said support including a raised hub centrally located on said support, and wherein said tray defines a central opening surrounded by an upstanding cylindrical wall constructed and arranged to fit over said hub, said tray wall and indicator having cooperating teeth which define said interengaging means for permitting relative incremental movement between said indicator and tray, said indicator and hub defining cooperating projections which interengage to retain the indicator in position relative to said support, said periodicity indicator being annular in shape and having an inverted U-shaped cross section, the outer wall of said indicator including inwardly extending teeth-like projections which cooperate with the teeth formed on the wall of said tray to provide for said incremental movement of said indicator relative to said tray, and the inner wall of said indicator defining an inwardly extending annular lip which forms the projection which engages with the projections on said hub to position the indicator relative to said support, and a removable tablet package disposed on said tray comprising a plurality of collapsible pockets each containing a tablet therein, said pockets arranged in a circular orientation and substantially equally spaced apart to thereby correspond with the orientation of said openings in said tray so that a tablet is disposed in alignment which each of said openings, said pockets being covered with a frangible membrane interposed between said pockets and said openings, said package being positively located with respect to said tray and rotatable therewith, whereby the starting period for the first tablet of a regimen can be preset by moving the periodicity indicator relative to said tray and tablets dispensed in the desired sequence by collapsing the pocket which is in registry with said aperture, thereby urging said tablet to fracture said membrane and pass through its corresponding opening and then through said aperture in said support for collection by the user thereof.

2. A tablet dispenser as defined by claim 1 in which said outer wall defines a downwardly extending portion that engages with said tray to position said tray relative to said support and said support defines an annular projection which engages with said tray so that said tray is properly positioned in said dispenser.

3. A tablet dispenser as defined in claim 1 which said means for providing incremental rotation of said periodicity indicator with respect to and independent of said tray selectively align a given indicia with any one of said openings and to maintain said alignment.

4. A tablet dispenser as defined in claim 1 in which the indicator includes an annular portion having a substantially flat upper surface disposed parallel to an upper surface defined by said hub, said indicator upper surface being the location where said indicators of periodicity are referenced to said individual openings in said tray.

5. A tablet dispenser as defined in claim 1 wherein said tray incremental rotation providing means includes a first set of ratchet teeth upstanding from said support, and a second set of ratchet teeth projecting from said tray and opposed to said first set, said sets of teeth adapted to engage with each other to allow incremental rotation of said tray on said support in one rotative direction, but not the other, said sets of teeth being disposed so that each opening of said tray locks in alignment with said aperture as the individual openings pass thereover.

6. A tablet dispenser as defined in claim 1 in which the tray defines an outer generally cylindrical wall, which wall defines a notch adapted to receive a tab formed on said tablet package to position the table package relative to said tray.

* * * * *